US009932803B2

(12) United States Patent
Batarseh et al.

(10) Patent No.: US 9,932,803 B2
(45) Date of Patent: Apr. 3, 2018

(54) HIGH POWER LASER-FLUID GUIDED BEAM FOR OPEN HOLE ORIENTED FRACTURING

(71) Applicant: Saudi Arabian Oil Company, Dhahran (SA)

(72) Inventors: Sameeh Issa Batarseh, Dhahran (SA); Hazim H. Abass, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 629 days.

(21) Appl. No.: 14/560,110

(22) Filed: Dec. 4, 2014

(65) Prior Publication Data

US 2016/0160618 A1 Jun. 9, 2016

(51) Int. Cl.

| | |
|---|---|
| ***E21B 43/114*** | (2006.01) |
| ***E21B 7/14*** | (2006.01) |
| ***E21B 7/18*** | (2006.01) |
| *E21B 10/60* | (2006.01) |

(52) U.S. Cl.

CPC ..... *E21B 43/114* (2013.01); *E21B 7/14* (2013.01); *E21B 7/18* (2013.01); *E21B 2010/607* (2013.01)

(58) Field of Classification Search

CPC . E21B 43/114; E21B 7/14; E21B 7/18; E21B 7/15; E21B 2010/607

See application file for complete search history.

(56) References Cited

U.S. PATENT DOCUMENTS

| | | | | |
|---|---|---|---|---|
| 3,821,510 A * | 6/1974 | Muncheryan | ..... | A61B 18/22 219/121.79 |
| 4,227,582 A | 10/1980 | Price | | |
| 4,458,766 A | 7/1984 | Siegel | | |
| 4,952,771 A * | 8/1990 | Wrobel | ..... | A61B 18/20 219/121.67 |

(Continued)

FOREIGN PATENT DOCUMENTS

| | | | | |
|---|---|---|---|---|
| WO | 2012031009 A1 | 3/2012 | | |
| WO | WO 2012031009 A1 * | 3/2012 | ..... | B08B 7/0042 |

OTHER PUBLICATIONS

International Search Report and Written Opinion for related PCT application PCT/US2015/063957 dated Mar. 7, 2016.

(Continued)

*Primary Examiner* — Robert E Fuller
*Assistant Examiner* — David Carroll
(74) *Attorney, Agent, or Firm* — Bracewell LLP; Constance Gall Rhebergen

(57) ABSTRACT

A laser-jet apparatus for creating a penetration through a stress region adjacent to a wellbore includes an outer tool housing, the outer tool housing having a housing central bore. A laser assembly includes a lens case with an outer diameter that is smaller than an inner diameter of the housing central bore, defining an annular passage between the outer tool housing and the lens case. A focusing lens and a collimating lens are located within the lens case. The focusing lens is shaped to control the divergence of a laser beam and the collimating lens is shaped to fix the diameter of the laser beam. A jet fluid path is located in the annular passage, the jet fluid path shaped to merge jet fluid with the laser beam. The outer tool housing has a frusto-conical tip for directing the combined jet fluid and laser beam to the stress region.

20 Claims, 3 Drawing Sheets

(56) References Cited

U.S. PATENT DOCUMENTS

| | | | | |
|---|---|---|---|---|
| 5,765,642 | A | 6/1998 | Surjaatmadja | |
| 7,086,484 | B2 | 8/2006 | Smith, Jr. | |
| 7,225,869 | B2 | 6/2007 | Willett et al. | |
| 7,487,834 | B2 | 2/2009 | Reed | |
| 7,490,664 | B2 | 2/2009 | Skinner et al. | |
| 7,503,404 | B2 | 3/2009 | McDaniel et al. | |
| 8,134,098 | B2 | 3/2012 | Muratsubaki et al. | |
| 8,356,935 | B2 | 1/2013 | Arora et al. | |
| 8,464,794 | B2 | 6/2013 | Schultz et al. | |
| 8,511,401 | B2 | 8/2013 | Zediker et al. | |
| 2005/0133226 | A1 | 6/2005 | Lehman | |
| 2006/0231257 | A1 | 10/2006 | Reed et al. | |
| 2008/0169275 | A1* | 7/2008 | Koseki | B23K 26/02 219/121.75 |
| 2010/0044103 | A1* | 2/2010 | Moxley | E21B 7/14 175/16 |
| 2011/0205652 | A1 | 8/2011 | Abbasi et al. | |
| 2012/0118568 | A1 | 5/2012 | Kleefisch et al. | |
| 2012/0248078 | A1 | 10/2012 | Zediker et al. | |
| 2013/0264118 | A1 | 10/2013 | Wideman et al. | |
| 2014/0054087 | A1* | 2/2014 | Wang | E21B 7/06 175/61 |
| 2014/0360778 | A1* | 12/2014 | Batarseh | E21B 7/15 175/17 |

OTHER PUBLICATIONS

Abass, H.H., et al.; Oriented Fracturing: A New Technique to Hydraulically Fracture an Openhole Horizontal Well; SPE Annual Technical Conf & Exhibition/New Orleans, LA; 10/4-7/09; Society of Petroleum Engineers; SPE-124483-MS.

Batarseh, S.I., et al.; High Power Laser Application in Openhole Multiple Fracturing with and Overview of Laser Research; Past, Present & Future; SPE SA Section Technical Symp & Exhibition/Khobar, SA; 04/8-11/12; Society of Petroleum Eng; SPE-160836-MS.

Halliburton | Production Solutions; Downhole Tool Solutions; Addressing the Downhole Challenges with Reliability; Aug. 2013; http://www.halliburton.com/public/bc/contents/Brochures/H010540.pdf.

Molian, R., et al.; Novel Laser/Water-Jet Hybrid Manufacturing Process for Cutting Ceramics; Journal of Manufacturing Science and Engineering vol. 130, No. 3; Jun. 2008; 10 Pages; American Society of Mechanical Engineers.

Richerzhagen, B., et al.; Water Jet Guided Laser Cutting: a Powerful Hybrid Technology for Fine Cutting and Grooving; Apr. 17, 2014; http://www.synova.ch/fileadmin/user_upload/conferences/ALAC04.pdf.

Tian, S., et al.; Research on Hydrajet Fracturing Mechanisms and Technologies; Oil Drilling & Production Technology; Feb. 2008; vol. 30, No. 1; www.cnki.com.cn.

* cited by examiner

HIGH POWER LASER-FLUID GUIDED BEAM FOR OPEN HOLE ORIENTED FRACTURING

BACKGROUND OF THE INVENTION

1. Field of the Invention

The present invention relates to operations in a wellbore associated with the production of hydrocarbons. More specifically, the invention relates to systems and methods for enhancing flow from a targeted hydrocarbon formation by creating a penetration through a region adjacent to the wellbore.

2. Description of the Related Art

The branch of petroleum engineering called wellbore stimulation includes the task of enhancing flow of production fluids from a hydrocarbon formation to the wellbore. To produce hydrocarbons from the targeted hydrocarbon formation, the hydrocarbon in the formation needs to be in communication with the wellbore. The flow from the hydrocarbon formation to the wellbore is carried out by the means of formation permeability. In tight formations when such permeability is low, stimulation can be applied around the wellbore and into the formation to enhance the flow and build a network of communication lines between the hydrocarbon formation and the wellbore.

The first stage of initiating this network of communication is commonly by pumping fluids through an isolated downhole device in the wellbore. The pressure is pumped at a high rate, exceeding the formation breaking pressure and causing the hydrocarbon formation and surrounding rocks to break and become fractured. This procedure is called hydraulic fracturing and is carried out mostly using a water based fluid called hydraulic fracture fluid. Hydraulic fracturing produces fractures in the hydrocarbon formation and creates networking between the hydrocarbon formation and the wellbore. However, hydraulic fracturing usually requires the use of an isolation device as well as rig intervention. There is very little control over the direction of the fracture and no control of where and when these fractures will be created.

Fluid jetting can alternately be used to create a hole in the formation. However, the diameter and depth of such holes are limited. In order to obtain a deeper hole the hole must be small, such as less than 1". Alternatively, holes can have large diameter but be shorter.

SUMMARY OF THE INVENTION

The systems and methods of this disclosure provide technologies to penetrate rocks in a subsurface formation. The proposed technique for hydraulic fracturing in open hole wells is to create a penetration that is generally perpendicular to the axis of the wellbore. The penetrations will pass through near wellbore stress zones and into the hydrocarbon formations.

The systems and methods disclosed herein combine fluid jetting with a laser. Both the heat from the laser beam and the jet fluid will be penetrating the hydrocarbon formation. The heat from the laser will weaken the formation, allowing deeper penetration. In addition, the heat from the laser beam will collapse clay content in the formation, improving flow properties. The proposed technique is to create these fractures without the need for an isolation device and with no rig intervention required.

In embodiments of the current disclosure the proposed technology is based on total internal reflection of two media. The jet fluid can merge with the laser beam. The jet fluid can act as a guide to the laser beam and perform in a way similar to fiber optics for the laser so that the laser beam follows the jet fluid path in every direction. Merging the high energy laser beam with the jet fluid allows the laser to follow the jet fluid and reach tight formations and in tortuosity where such areas couldn't be reached by the laser beam only. The laser beam provides a heat source and the jet fluid provides mechanical jet power. The jet fluid distributes the heat of the laser beam so that a wider range of heat will be distributed into the hydrocarbon formation. In this way, the orientation and geometry of the penetration can be controlled and a larger diameter and greater depth of the penetration can be obtained.

In an embodiment of the current disclosure, a laser-jet apparatus for creating a penetration through a stress region adjacent to a wellbore of a subterranean well includes an outer tool housing. The outer tool housing is a tubular member with a housing central bore. A laser assembly has a lens case located in the housing central bore with an outer diameter that is smaller than an inner diameter of the housing central bore, defining an annular passage between the tool housing and the lens case. A focusing lens is located within the lens case, the focusing lens shaped to control the divergence of a laser beam passing through the lens case. A collimating lens is located within the lens case, the collimating lens shaped to fix the diameter of the laser beam. A jet fluid path is located in the annular passage, the jet fluid path shaped to merge a jet fluid with the laser beam. The outer tool housing has a frusto-conical tip at an exit end, the frusto-conical tip shaped to direct the combined jet fluid and laser beam to the stress region adjacent the wellbore.

In alternate embodiments, a temperature sensor system can be located within the laser-jet apparatus to measure a temperature of the laser-jet apparatus and shut down the laser-jet apparatus if a measured temperature exceeds a predetermined temperature. A cover lens can be located within the lens case closer to an outlet end of the lens case than the focusing lens and the collimating lens. A fluid knife can be located within the outer tool housing and oriented to direct a deflector fluid stream in a direction across the laser beam, deflecting debris away from the cover lens. The focusing lens, the collimating lens, and the frusto-conical tip can be coaxial.

In other alternate embodiments, the jet fluid path has a parallel section that is parallel to the lens case, and an angled section that is angled relative to the lens case at an angle selected so that the jet fluid merges with the laser beam at an angle of incidence greater than a critical angle of the laser beam. A purging nozzle can be located within the outer tool housing, the purging nozzle oriented to direct a purging fluid along a direction of the laser beam.

In yet other alternate embodiments, a rotating joint can be connected to the outer tool housing for rotating the frusto-conical tip of the outer tool housing to point in any direction 360 degrees about an axis of the wellbore. The outer tool housing can include a head portion and a connector portion, the rotating joint being located between the head portion and the connector portion and the connector portion being connected to a tubular member that is selectively moved into and out of the wellbore. A high power laser unit can be located at a surface proximate to the wellbore and provide the laser beam to the lens case. A fiber optics cable can have a first end in communication with the high power laser unit and a second end in communication with the lens case.

In another embodiment of the current disclosure, a method for creating a penetration through a stress region adjacent to a wellbore of a subterranean well includes providing a laser-jet apparatus having an outer tool housing, a laser assembly with a lens case, a focusing lens, and a collimating lens. The laser-jet apparatus further includes a jet fluid path located in an annular passage between the outer tool housing and the lens case. The laser-jet apparatus is lowered into the wellbore and a laser beam is directed through the focusing lens. The divergence of the laser beam is controlled with the focusing lens. The laser beam can then be directed through the collimating lens and the diameter of the laser beam can be fixed with the collimating lens. A jet fluid is pumped through the jet fluid path and the jet fluid is merged with the laser beam to define a laser-fluid jet beam. A frusto-conical tip of the tool housing is directed towards the stress region adjacent to the wellbore and the penetration in the stress region adjacent to the wellbore is created with the laser-fluid jet beam.

In alternate embodiments, the critical angle of the laser beam is determined and the jet fluid is merged with the laser beam at an angle of incidence greater than the critical angle of the laser beam. A temperature of the laser-jet apparatus can be measured with a temperature sensor system and the temperature sensor system can shut down the laser-jet apparatus if the measured temperature exceeds a predetermined temperature.

In other alternate embodiments, the laser-jet apparatus has a cover lens located within the lens case closer to an outlet end of the lens case than the focusing lens and the collimating lens. A deflector fluid stream can be directed in a direction across the laser beam with a fluid knife to deflect debris away from the cover lens. The laser-jet apparatus can have a purging nozzle located within the outer tool housing, purging fluid along a direction of the laser beam.

In yet other alternate embodiments, the step of directing a frusto-conical tip of the tool housing towards the stress region adjacent to the wellbore can include rotating the frusto-conical tip of the outer tool housing to point in any direction 360 degrees about an axis of the wellbore so that the frusto-conical tip is guided towards a desired penetration location. The step of lowering the laser-jet apparatus into the wellbore can include lowering the laser-jet apparatus with coiled tubing. The laser beam can be generated with a high power laser unit located at a surface proximate to the wellbore, and the laser beam can be delivered to the lens case with a fiber optics cable. The frusto-conical tip of the tool housing can be guided towards another stress region adjacent to the wellbore and the process repeated to create another penetration.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments or positions.

In the following discussion, numerous specific details are set forth to provide a thorough understanding of the present invention. However, it will be obvious to those skilled in the art that the present invention can be practiced without such specific details. Additionally, for the most part, details concerning well drilling, reservoir testing, well completion and the like have been omitted inasmuch as such details are not considered necessary to obtain a complete understanding of the present invention, and are considered to be within the skills of persons skilled in the relevant art.

Figure 1:
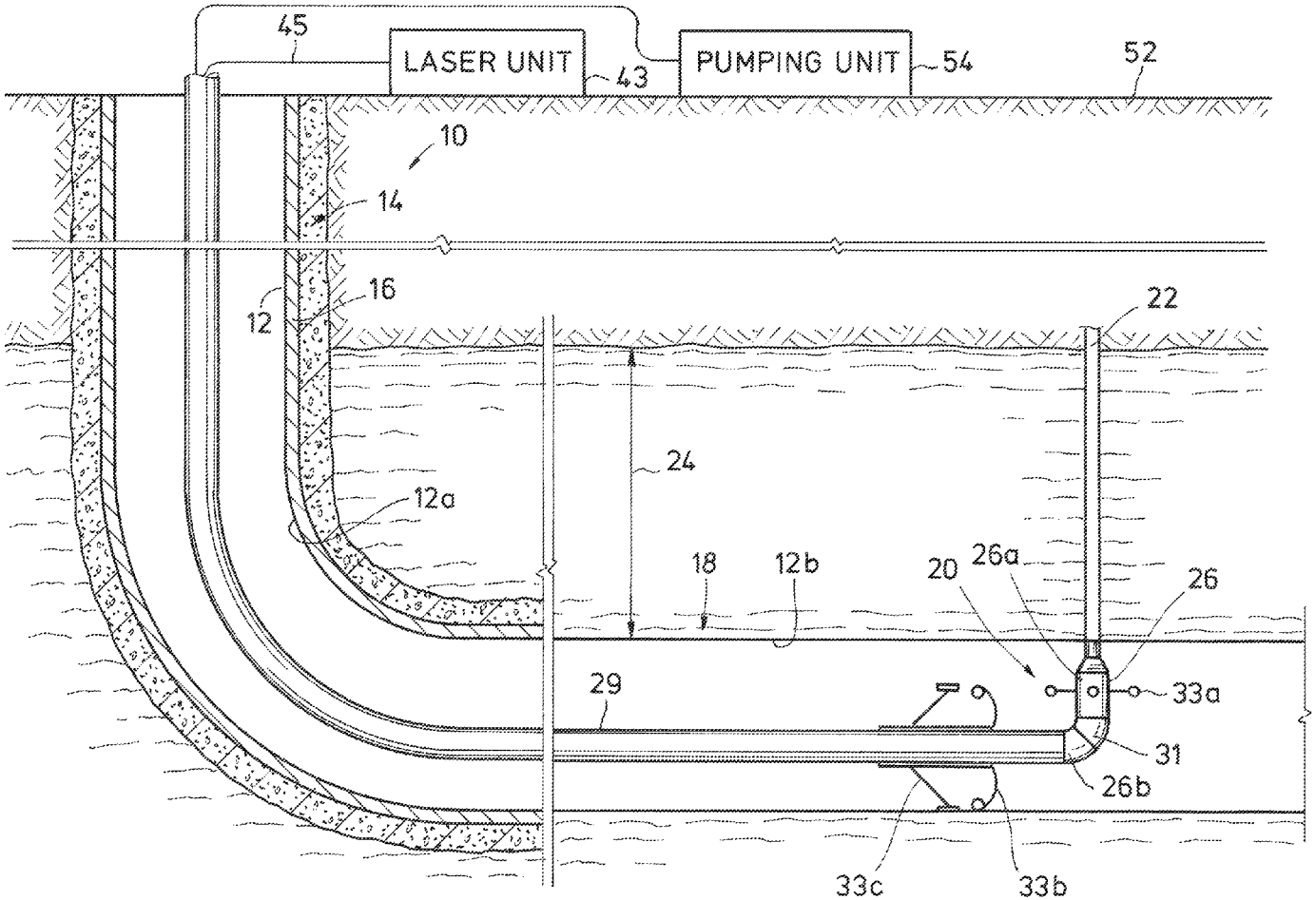
FIG. 1 is a schematic view of a wellbore having a laser-jet apparatus in accordance with an embodiment of this disclosure.
Figure 2:
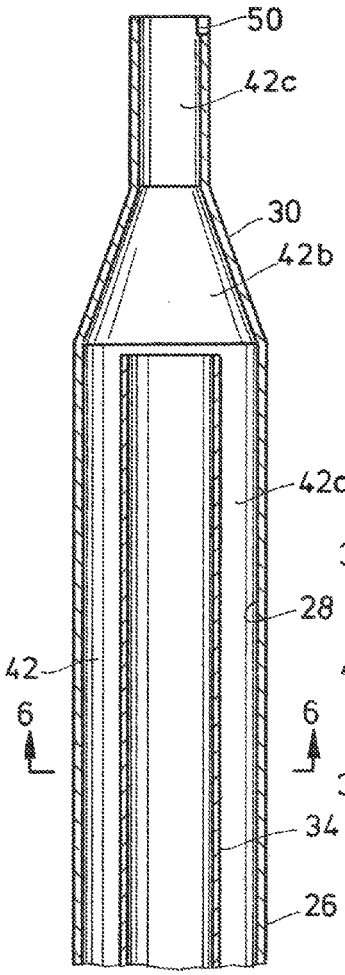
FIG. 2 is a section view of the outer tool housing of the laser-jet apparatus of FIG. 1.
Figure 3:
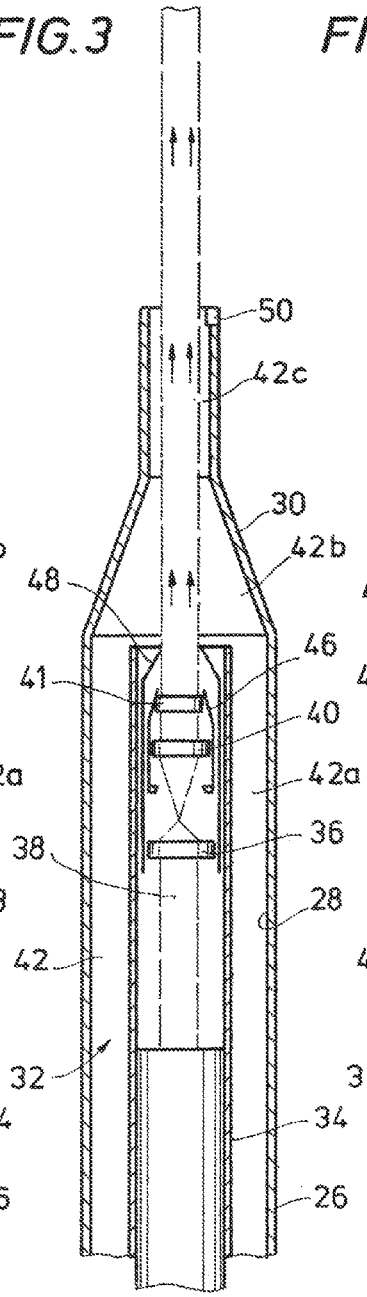
FIG. 3 is a section view of the laser-jet apparatus of FIG. 1, showing the laser beam.
Figure 4:
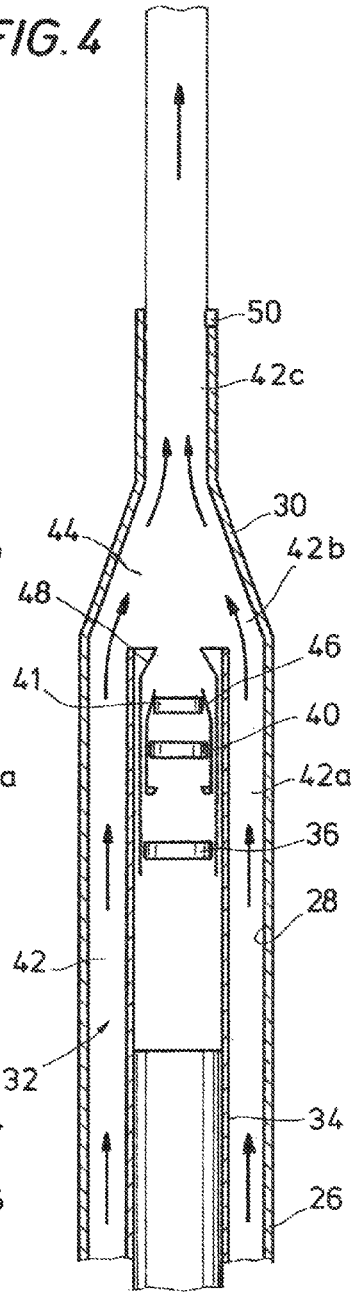
FIG. 4 is a section view of the laser-jet apparatus of FIG. 1, showing the jet fluid.
Figure 5:
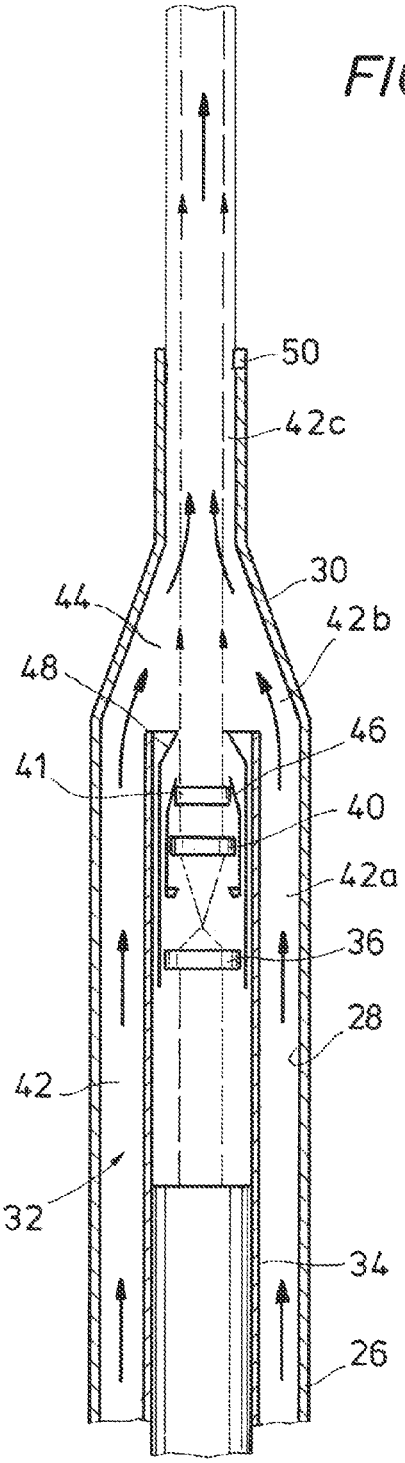
FIG. 5 is a section view of the laser-jet apparatus of FIG. 1, showing both the laser beam and the jet fluid.
Figure 6A:
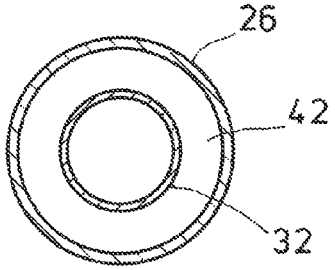
FIGS. 6*a*-6*b* are cross section views of the laser-jet apparatus in accordance with embodiments of this disclosure.
Figure 6B:
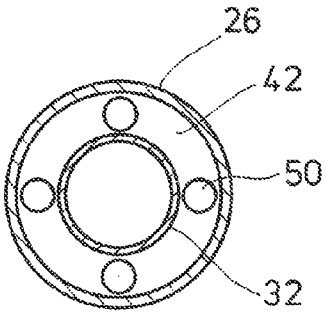

Referring to FIG. 1, a hydrocarbon development includes subterranean well 10. Wellbore 12 of subterranean well 10 includes a main bore 12*a* which is generally vertical, and a horizontal or lateral bore 12*b* that extends from main bore 12*a*. Subterranean well 10 has a lined section 14, which has a tubular casing or liner 16 along the inner circumference of wellbore 12. Subterranean well 10 also has an open or unlined section 18, which is open in that there is no tubular member along the inner circumference of wellbore 12. Subterranean well 10 can alternately be a generally vertical well without a horizontal or lateral bore.

Looking now at FIGS. 1-6*a*-6*b*, laser-jet apparatus 20 can be located within wellbore 12, for creating penetration 22 through stress region 24 adjacent to wellbore 12 of a subterranean well 10. Laser-jet apparatus 20 can be located within, and perform its function in, either a lined section 14 or an unlined section 18. Laser-jet apparatus 20 includes outer tool housing 26. Outer tool housing 26 is a generally tubular member having housing central bore 28 that surrounds other components of laser-jet apparatus 20, which components will be discussed herein, to protect such components.

Outer tool housing 26 has a frusto-conical tip 30 at an exit end of outer tool housing 26. Outer tool housing 26 includes a head portion 26*a* and a connector portion 26*b*. Connector portion 26*b* is connected to tubular member 29 that is selectively moved into and out of wellbore 12. Tubular member 29 can be, for example, coiled tubing or can be other specialized tubing or tubular member that can move tool housing into and out of wellbore 12.

Rotating joint 31 is connected to outer tool housing 26 for selectively rotating frusto-conical tip 30 of outer tool housing 26 to point in any direction 360 degrees about an axis of wellbore 12. Rotating joint 31 also allows outer tool housing to rotate in other directions so that outer tool housing is no longer pointing in a direction normal to the axis of wellbore 12. Rotating joint 31 is located between head portion 26*a* and connector portion 26*b*. Connector portion 26*b* is a specialized connector designed to secure outer tool housing 26 to tubular member 29.

Centralizers 33*a*, 33*b*, 33*c* can are located at various positions along an outer diameter of tubular member 29 and outer tool housing 26. Centralizers 33*a*, 33*b*, 33*c* centralize tubular member 29, outer tool housing 26 and rotating join 31, and align tubular member 29, outer tool housing 26 and rotating join 31 within wellbore 12. Centralizers 33*a*, 33*b*, 33*c* can also sense a cavity or irregular hole within wellbore 12 and prevent laser-jet apparatus 20 from becoming stuck in such cavity or irregular hole.

Laser-jet apparatus 20 also includes laser assembly 32. Laser assembly 32 has lens case 34 that is located within central bore 28. Lens case 34 is a tubular member that has an outer diameter that is smaller than an inner diameter of central bore 28, so that an annular passage is formed between outer tool housing 26 and lens case 34. Inside of an inner bore of lens case 34 is focusing lens 36. Focusing lens 36 is positioned to be the first lens that a raw laser beam 38 comes into contact with. Focusing lens 36 is shaped and located within lens case 34 to control the divergence of laser beam 38, which is passing through the inner bore of lens case 34. Also located within the inner bore of lens case 34 is collimating lens 40. Collimating lens 40 is shaped and located within the inner bore of lens case 34 to collimate laser beam 38 and fix the diameter of laser beam 38. Laser beam 38 passes through collimating lens 40 after passing through focusing lens 36. A third lens, cover lens 41, is located within lens case 34. Cover lens 41 is located closer to an outlet end of lens case 34 than focusing lens 36 and collimating lens 40. Cover lens 41 acts as a mechanical barrier to protect the other components located in the inner bore of lens case 34. Lenses 36, 40, 41 are generally disk shaped and extend across the inner bore of lens case 34. In the embodiments of this disclosure, lenses 36, 40, 41 and frusto-conical tip 30 are coaxial.

Laser beam 38 can be generated by a high power laser unit 43 located at surface 52 proximate to the top of wellbore 12 and providing laser beam 38, as a high power laser beam, to lens case 34. Fiber optics cable 45 can be a high power fiber optics cable with a first end in communication with high power laser unit 43 and a second end in communication with lens case 34 and delivering laser beam 38 from high power laser unit 43 to lens case 34.

Laser assembly 32 also includes jet fluid path 42. Jet fluid path 42 is shaped to merge jet fluid 44 with laser beam 38. Jet fluid path 42 has a parallel section 42*a* that is generally parallel to lens case 34, and an angled section 42*b* that is angled relative to lens case 34. Parallel section 42*a* is defined by the annular passage formed between outer tool housing 26 and lens case 34. Angled section 42*b* of jet fluid path 42 is at an angle selected so that jet fluid 44 merges with laser beam 38 at an angle of incidence that is greater than a critical angle of laser beam 38. Jet fluid path 42 can additionally include an end portion 42*c* that is located past angled section 42*b* and directs a jet fluid 44. Angled section 42*b* and end portion 42*c* extend beyond lens case 34 so that they are generally circular in cross section rather than annular in cross section.

The critical angle of laser beam 38 can be measured for a given wave length and the angle of angled section 42*b* can be set for jet fluid 44 to intersect with laser beam 38 so that jet fluid 44 merges with laser beam 38 at an angle of incidence greater than the measured critical angle of laser beam 38. The critical angle and angle of incidence will be determined experimentally and will depend in part on the wavelength of the laser beam 38 and the media through which laser beam 38 will travel. When laser beam 38 then travels within jet fluid 44 and towards the boundary of jet fluid 44 with air, all of laser beam 38 will be reflected back within jet fluid 44 and none of laser beam 38 will be refracted and travel out of jet fluid 44. In this way, laser beam 38 will follow the path of jet fluid 44. Therefore jet fluid 44 can be a guide to laser beam 38, with jet fluid 44 acting in a manner similar to fiber optics for laser beam 38 so that laser beam 38 follows the path of jet fluid 44 in every direction.

After laser beam 38 and jet fluid 44 are merged, they exit outer tool housing 26 by way of frusto-conical tip 30, which forms and forces the flow of the combined jet fluid and laser beam in one direction and to the stress region adjacent the wellbore.

Fluid knife 46 and purging nozzle 48 are also located within outer tool housing 26. Fluid knife 46 is located within lens case 34, proximate to cover lens 41. Fluid knife 46 can be located closer to the outlet end of lens care 32 than cover lens 41. Fluid knife 46 can be oriented to direct a deflector fluid stream in a direction across laser beam 38, deflecting debris and dust away from cover lens 41. Fluid knife 46 can be, for example, an air knife that blows a continuous curtain air across laser beam 38.

Purging nozzle 48 is also located closer to the outlet end of lens case 34 than cover lens 41. Purging nozzle 48 is oriented to direct a purging fluid along a direction of laser beam 38. The purge fluid can be a non-reactive liquid or gas and can remove debris from the path of laser beam 38. The purge fluid will travel out of frusto-conical tip 30. The tapered shape of frusto-conical tip 30 as well as the continuous stream of purge fluid being directed out of frusto-conical tip 30 will restrict flow back of debris and dust and limit the amount of debris and dust that is able to enter into outer tool housing 26. The purge fluid can be, for example, water, halocarbon or any fluid that does not absorb laser energy. The purging fluid can clean the penetration 22, remove debris, clear the path for the laser beam 38, and cool the penetration 22.

Laser-jet apparatus 20 also includes temperature sensor system 50 located to measure a temperature of laser-jet apparatus 20 and shut down laser-jet apparatus 20 if a measured temperature exceeds a predetermined temperature, to prevent overheating. The predetermined temperature can be selected to be a temperature above which damage would be done to laser-jet 42 apparatus 20 if laser-jet apparatus 20 continued to operate at such temperature. Temperature sensor system 50 can include a temperature sensor located on or near to outer tool housing 26 at parallel section 42*a* (FIG. 6B), or at end portion 42*c* (FIG. 6A), or at another location along jet fluid path 42. Temperature sensor system 50 can also include a control system for receiving temperature information, relaying temperature information to an operator, and for automatically shutting down laser-jet apparatus 20 if the measured temperature exceeds the predetermined temperature.

In embodiments of this disclosure, each of the laser beam 38, jet fluid 44, fluid for deflector fluid stream of fluid knife 46, and purge fluid for purging nozzle 48, as well as control systems for providing signals to control the operation of laser-jet apparatus 20 can be transmitted from surface 52 through tubular member 29 to reach outer tool housing 26 and applicable components of laser-jet apparatus 20.

In an example of operation, penetration 22 is created through a stress region adjacent to a wellbore of both horizontal wells and vertical wells by combing fluid jetting with a high powered laser. As a first step, the critical angle of laser beam 38 generated by high power laser unit 43 laser can be determined for a particular wavelength. Laser-jet apparatus 20 can then be adjusted so that jet fluid 44 will merge with laser beam 38 at an angle of incidence greater than the critical angle of laser beam 38.

Laser-jet apparatus 20 can be attached to tubular member 29 and lowered into wellbore 12 to a desired target location. This can be accomplished by using a coiled tubing unit or, optionally, with a rig. High powered laser unit 43 can then be energized and laser beam 38 generated. Fluid knife 46 can direct a deflector fluid stream in a direction across laser beam 38 to deflect debris away from the cover lens and purging nozzle 48 can purge fluid along a direction of laser beam 38 to restrict flow back of debris and dust and limit the amount of debris and dust that is able to enter into outer tool housing 26.

Fiber optics cable 45 will deliver laser beam 38 to the lens case 34. At lens case 34, laser beam 38 will first be directed through focusing lens 36 to control the divergence of laser beam 38 and then will be directed through collimating lens 40 to fix the diameter of laser beam 38. Jet fluid 44 is pumped through jet fluid path 42 by pumping unit 54 located at surface 52. Jet fluid 44 merges with laser beam 38 to define a laser-fluid jet beam. Frusto-conical tip 30 of outer tool housing 26 is directed towards stress region 24 adjacent to wellbore 12. Frusto-conical tip 30 of outer tool housing 26 can be rotated to point in any direction 360 degrees about an axis of wellbore 12 so that frusto-conical tip 30 is guided towards a desired penetration location. Laser-fluid jet beam creates penetration 22 into and through stress region 24 to reach the hydrocarbon formation. The laser-fluid jet beam can operate, for example, from four seconds to sixty minutes, depending on the desired depth of penetration 22.

During the process of creating penetration 22, the temperature of laser-jet apparatus 20 will be measured with temperature sensor system 50. Temperature sensor system 50 can automatically, without operator intervention, shut down laser-jet apparatus 20 if the measured temperature exceeds a predetermined temperature, in order to protect laser-jet apparatus 20 from overheating.

After completing penetration 22, laser beam 38 and jet fluid 44 can be stopped. Laser-jet apparatus 20 can be moved farther into, or moved out of, wellbore 12 and frusto-conical tip 30 can be rotated to be guided towards another stress region adjacent to wellbore 12. Laser beam 38 can be turned back on and jet fluid 44 can be restarted and another penetration 22 can be created. This procedure can be repeated as necessary or desired to reach a target level of networking between the hydrocarbon formation and wellbore 12.

Systems and methods of this disclosure therefore have the ability to increase production from tight formations and unconventional reservoir. Production is increased in existing wells by reaching bypassed hydrocarbon zones. Providing control over the orientation of the penetration to reach desire target will improve overall recovery efficiency and production.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A laser-jet apparatus for creating a penetration through a stress region adjacent to a wellbore of a subterranean well, the laser-jet apparatus comprising:

an outer tool housing, the outer tool housing being a tubular member with a housing central bore;

a laser assembly, the laser assembly having:

a lens case located in the housing central bore with an outer diameter that is smaller than an inner diameter of the housing central bore, defining an annular passage between the tool housing and the lens case;

a focusing lens located within the lens case, the focusing lens shaped to control the divergence of a laser beam passing through the lens case and define a focal point of the laser beam; and a collimating lens located within the lens case, the collimating lens shaped to fix the diameter of the laser beam;

a jet fluid path located in the annular passage, the jet fluid path shaped to merge a jet fluid with the laser beam downstream of the focal point of the laser beam; and wherein the outer tool housing has a frusto-conical tip at an exit end, the frusto-conical tip shaped to direct the combined jet fluid and laser beam to the stress region adjacent the wellbore.

2. The laser-jet apparatus according to claim 1, further including a temperature sensor system located to measure a temperature of the laser-jet apparatus and shut down the laser-jet apparatus if a measured temperature exceeds a predetermined temperature.

3. The laser-jet apparatus according to claim 1, further including a cover lens located within the lens case closer to an outlet end of the lens case than the focusing lens and the collimating lens.

4. The laser-jet apparatus according to claim 3, further comprising a fluid knife located within the outer tool housing, the fluid knife oriented to direct a deflector fluid stream in a direction across the laser beam, deflecting debris away from the cover lens.

5. The laser-jet apparatus according to claim 1, wherein the jet fluid path has a parallel section that is parallel to the lens case, and an angled section that is angled relative to the lens case at an angle selected so that the jet fluid merges with the laser beam at an angle of incidence greater than a critical angle of the laser beam.

6. The laser-jet apparatus according to claim 1, further comprising a purging nozzle located within the outer tool housing, the purging nozzle oriented to direct a purging fluid in along a direction of the laser beam.

7. The laser-jet apparatus according to claim 1, further comprising a rotating joint connected to the outer tool housing selectively rotating the frusto-conical tip of the outer tool housing to point in any direction 360 degrees about an axis of the wellbore.

8. The laser-jet apparatus according to claim 7, wherein the outer tool housing includes a head portion and a connector portion, the rotating joint being located between the head portion and the connector portion and the connector portion being connected to a tubular member that is selectively moved into and out of the wellbore.

9. The laser-jet apparatus according to claim 1, further comprising a high power laser unit located at a surface proximate to the wellbore and providing the laser beam to the lens case.

10. The laser-jet apparatus according to claim 9, further comprising a fiber optics cable with a first end in communication with the high power laser unit and a second end in communication with the lens case.

11. The laser-jet apparatus according to claim 1, wherein the focusing lens, the collimating lens and the frusto-conical tip are axially aligned.

12. A method for creating a penetration through a stress region adjacent to a wellbore of a subterranean well, the method comprising:

(a) providing a laser-jet apparatus having an outer tool housing, a laser assembly with a lens case, a focusing lens, and a collimating lens, the laser-jet apparatus further including a jet fluid path located in an annular passage between the outer tool housing and the lens case;

(b) lowering the laser-jet apparatus into the wellbore;

(c) directing a laser beam through the focusing lens and controlling the divergence of the laser beam with the focusing lens to define a focal point of the laser beam;

(d) directing the laser beam through the collimating lens and fixing the diameter of the laser beam with the collimating lens;

(e) pumping a jet fluid through the jet fluid path and merging the jet fluid with the laser beam downstream of the focal point of the laser beam to define a laser-fluid jet beam; and (f) directing a frusto-conical tip of the tool housing towards the stress region adjacent to the wellbore and creating the penetration in the stress region adjacent to the wellbore with the laser-fluid jet beam.

13. The method according to claim 12, further comprising determining the critical angle of the laser beam and merging the jet fluid with the laser beam at an angle of incidence greater than the critical angle of the laser beam.

14. The method according to claim 12, further comprising measuring a temperature of the laser-jet apparatus with a temperature sensor system, the temperature sensor system shutting down the laser-jet apparatus if the measured temperature exceeds a predetermined temperature.

15. The method according to claim 12, wherein the laser-jet apparatus has a cover lens located within the lens case closer to an outlet end of the lens case than the focusing lens and the collimating lens, the method further comprising direct a deflector fluid stream in a direction across the laser beam with a fluid knife to deflect debris away from the cover lens.

16. The method according to claim 12, wherein the laser-jet apparatus has a purging nozzle located within the outer tool housing, the method further comprising purging fluid along a direction of the laser beam.

17. The method according to claim 12, wherein the step of directing a frusto-conical tip of the tool housing towards the stress region adjacent to the wellbore includes rotating the frusto-conical tip of the outer tool housing to point in any direction 360 degrees about an axis of the wellbore so that the frusto-conical tip is guided towards a desired penetration location.

18. The method according to claim 12, wherein the step of lowering the laser-jet apparatus into the wellbore includes lowering the laser-jet apparatus with coiled tubing.

19. The method according to claim 12, further comprising generating the laser beam with a high power laser unit located at a surface proximate to the wellbore, and delivering the laser beam to the lens case with a fiber optics cable.

20. The method according to claim 12, further comprising after step (f), guiding the frusto-conical tip of the tool housing towards another stress region adjacent to the wellbore and repeating steps (c) to (f).

* * * * *